United States Patent [19]

Jewett

[11] Patent Number: 5,033,949

[45] Date of Patent: Jul. 23, 1991

[54] HOLE REPAIR APPARATUS

[76] Inventor: Scott E. Jewett, 1126 W. 228th St. #25, Torrance, Calif. 90502

[21] Appl. No.: 383,853

[22] Filed: Jul. 21, 1989

[51] Int. Cl.[5] ..... E04G 23/02

[52] U.S. Cl. ..... 425/12; 52/514; 264/30; 264/36; 428/63

[58] Field of Search ..... 425/11-13; 264/30, 36; 52/514; 428/63; 156/98

[56] References Cited

U.S. PATENT DOCUMENTS

| | | | |
|---|---|---|---|
| 503,079 | 8/1893 | Gowen | 264/30 |
| 3,325,955 | 6/1967 | Haut | 52/514 |
| 3,373,467 | 3/1968 | Loughrey . | |
| 3,583,122 | 6/1971 | Biegajski | 52/514 |
| 3,690,084 | 4/1971 | LeBlanc . | |
| 3,874,505 | 8/1973 | Mirarchi . | |
| 3,999,347 | 1/1976 | Devlin . | |
| 4,075,809 | 2/1978 | Sirkin | 52/514 |
| 4,100,712 | 6/1976 | Hyman . | |
| 4,193,243 | 3/1978 | Tiner . | |
| 4,354,332 | 4/1980 | Lentz . | |
| 4,471,594 | 9/1984 | Doyle | 52/514 |
| 4,578,854 | 4/1986 | Demeglio | 52/514 |
| 4,715,151 | 12/1987 | Garblik | 52/514 |
| 4,820,564 | 4/1989 | Cologna et al. | 52/514 |
| 4,848,056 | 7/1989 | Kelly | 52/514 |

*Primary Examiner*—James C. Housel

[57] ABSTRACT

A device for repairing a hole in an object, including a flexible backing member which can be bent and positioned through a hole, of smaller diameter than the backing member, in order to support and position a fluent patching material. A rigid front dam is then positioned on the front of the hole and attached to the backing member using a connecting member. Front dam may have an impressionable material on one of its sides so that a desired texture can be impressed, and cast on the front of the hole repair.

2 Claims, 3 Drawing Sheets

HOLE REPAIR APPARATUS

BACKGROUND OF THE INVENTION

1. Field of Invention

The invention relates to an improved apparatus and process for repairing a damaged area to a planar surface. It is particularly useful in situations where the back side of the surface is inaccessible and the cosmetic appearance of the front surface is of importance such as in the repair of plasterboard walls.

2. Description of Prior Art

Heretofore, repairing a hole in a planar surface, such as a plasterboard wall involved several difficult steps and resulted in a cosmetically undesirable finish. The difficulties arise in trying to contain a fluent patching compound until it sets. Additionally, manually creating a finish that blends in with the existing texture and shape is difficult and often results in an "obvious repair". In trying to overcome these difficulties some methods for patching holes have been developed, however, none solve the need for a structurally sound repair as well as a cosmetically acceptable finish.

Several inventors have attempted to solve the problems inherent in this type of repair. U.S. Pat. No. 4354332 to Lentz (1982) describes an apparatus for repairing holes in drywall. Although it attempts to solve the problems of containment of a fluent patching compound, it requires a substantial size slot or hole in its front containment dam, which when in use, will allow said compound to extrude, leaving a bump on the surface of the repair. Additionally, the front dam and backing means being substantially rigid does not allow for pushing of said compound forward for a cosmetically unblemished surface. U.S. Pat. No. 4100712 to Hyman (1978) uses a non-slotted front dam and a metal "basket" shaped backing means for containment of a patching compound. Although front containment is smooth and uninterrupted, it provides no means for pushing said compound forward to eliminate gaps or bubbles. U.S. Pat. Nos. 4193243, 3999347, 3874505, 3690084, 3373467 present methods for holding a backing means in place with no mention of containment with a front dam.

These inventors have attempted to solve part of the problem. None, however, create a method that contains a patching compound, pushes said compound forward against a front dam to eliminate gaps or bubbles, and provides a means to copy the shape and texture of the existing surface.

SUMMARY OF INVENTION

Accordingly, several objects and advantages of my invention are:

a) a backing means that contains a fluent patching material as well as pushes said material forward from the center outward, against a front dam, leaving few bubbles or gaps.

b) it incorporates a rigid front dam with a pliable surface so that a desired texture of shape can be impressed and cast.

c) a backing means that is flexible yet resilient whereby, it can be bent and inserted through a hole that has a diameter which is smaller than the diameter of said backing means. This will be useful when the back side of the surface is inaccessible.

d) a connecting means which is adjustable and when attached to the centers of the front dam means and the backing means will draw them progressively closer to each other.

DESCRIPTION OF THE PREFERRED EMBODIMENT

Figure 1:
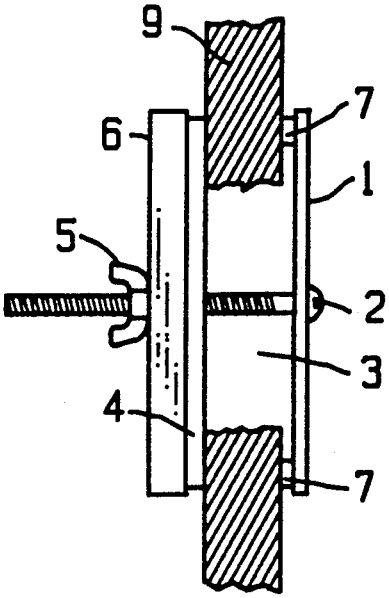
FIG. 1 A schematic side view of the repair apparatus in position on a hole in a planar surface.

As illustrated in FIG. 1, this Hole Repair Kit and Procedures has three main parts: a backing means(1) a connector means(2) and a front dam means(6).

Figure 3:
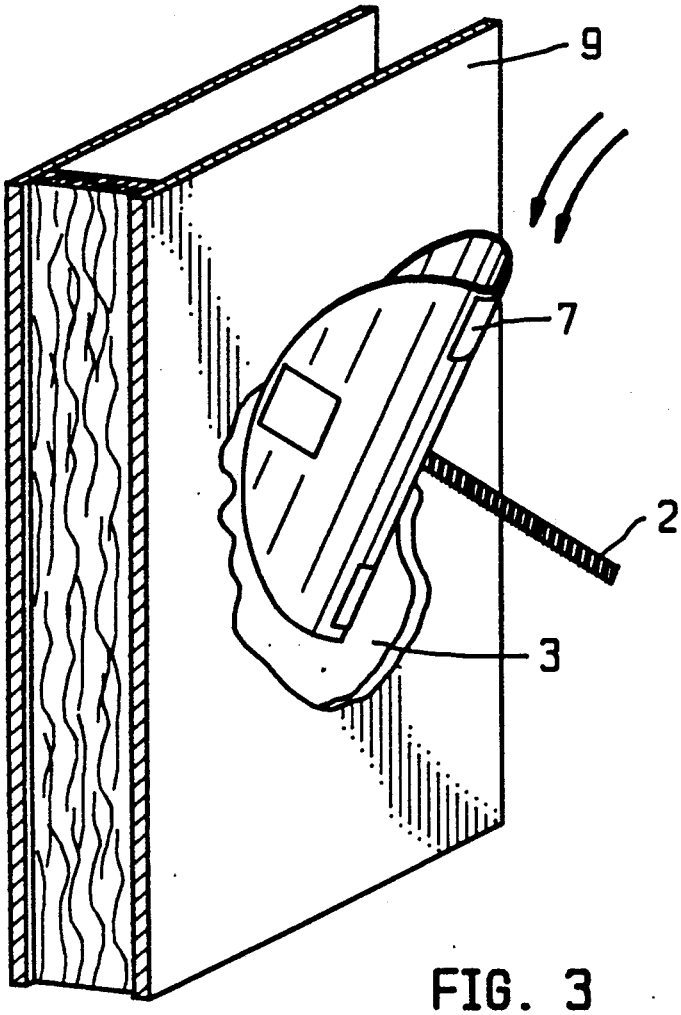
FIG. 3 a manipulation technique for positioning the backing means behind a hole in which the rear surface is inaccessible.
Figure 5:
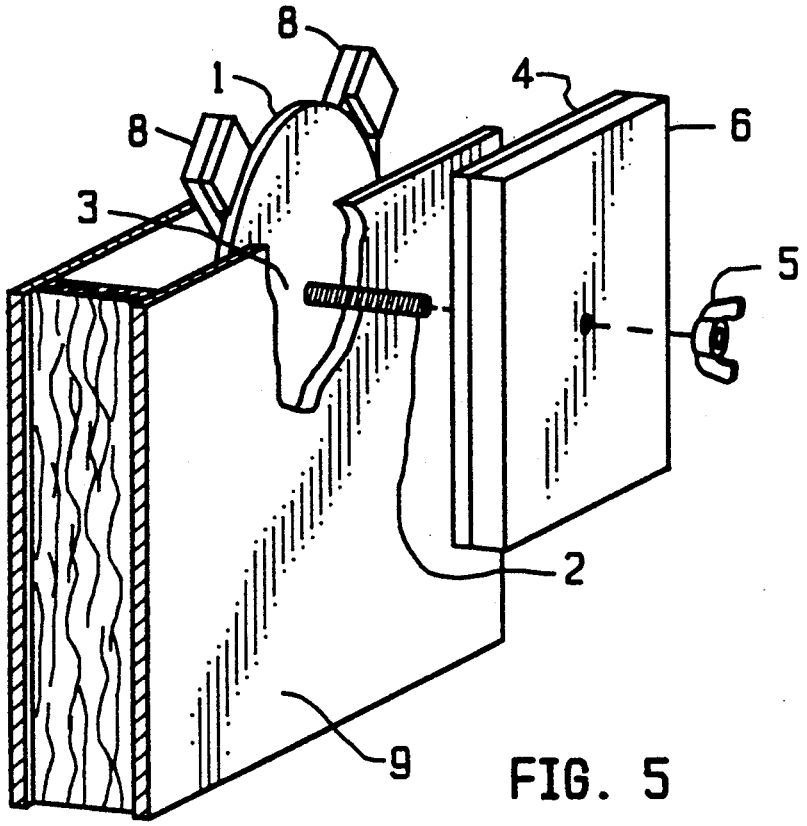
FIG. 5 a pictorial representation of the preferred embodiment and its assembly in a cutaway of a planar wall section.

The backing means (1) is of a size greater than the diameter of the hole or damage(3) on the panel(9). It is constructed of a pliable sheet, such as plastic, that can be folded in order to be positioned through said hole (FIG. 3) and will subsequently retain its original shape to cover the rear side of the hole(FIG. 5). It may have adhesive pads (7) on its inside edges so that it can be pulled against said panel (9). Thus, it remains permanently positioned and completely covers that back of said hole(3). It may also be held in place manually during the patching procedure.

Figure 7:
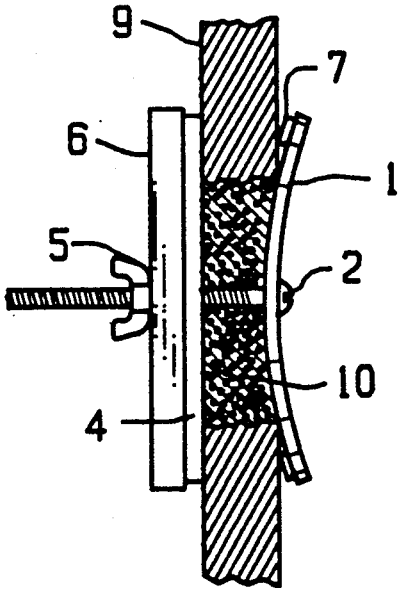
FIG. 7 a schematic side view of the repair apparatus in place, illustrating the convexing backing means and subsequent manipulation and compression of a fluent patching material.

A connecting means (2) such as a bolt, string or cord, connects from the center of the backing means (1) and extends through said hole(3) in said panel (9) through the front dam means (6). Said connector (2) is to be of narrow construction as not to impair the appearance of the finished repair and is to be of sufficient strength to concave the backing means(1) when said connecting means is tightened (FIG. 7).

The front dam means (6) is also larger than said hole and is of a rigid construction. One side of said front dam means(6) may be impregnated with a pliable material used to make an impression of the desired surface texture. The impressionable material may also be impregnated on a separate sheet(4) for ease of use.

Figure 2:
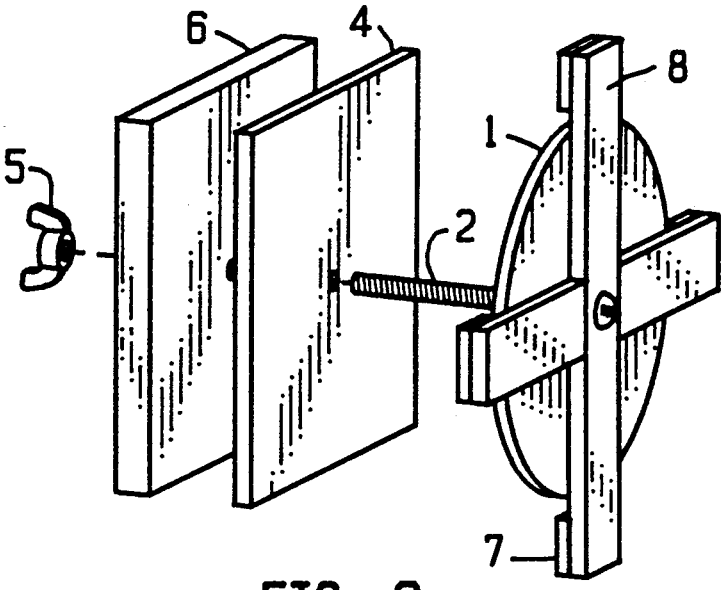
FIG. 2 A pictorial representation of the preferred embodiment including optional crossing strips for larger holes.

For larger holes it may be necessary to add crossing strips (8) for additional support (FIG. 2). The strips (8) are notched (FIG. 4) so that they can "lock" into a fixed flush "+" shape (FIG. 2). Said strips may also be aligned (FIG. 4) so that the flexible sheet (1) can be bent and the entire unit fit through said hole (3) It can then be re-erected into the "+" shape and adhered to the rear of said hole(3) (FIG. 5).

As figure illustrates the connecting means(2) is permanently attached to the backing means(1) through its center and extends to the front of the panel(9) where the front dam (6) is attached.

Operation of invention

In operation, the hole(3) to be repaired is shaped to a rough circular shape approximately one inch smaller in diameter than the backing means (1). Any loose pieces are removed from around said hole in preparation for patching.

The impressionable portion of the front dam (4) (FIG. 2) is now pressed firmly against the desired texture/shape making a negative copy of the desired texture on the impressionable side of front dam.

Figure 4:
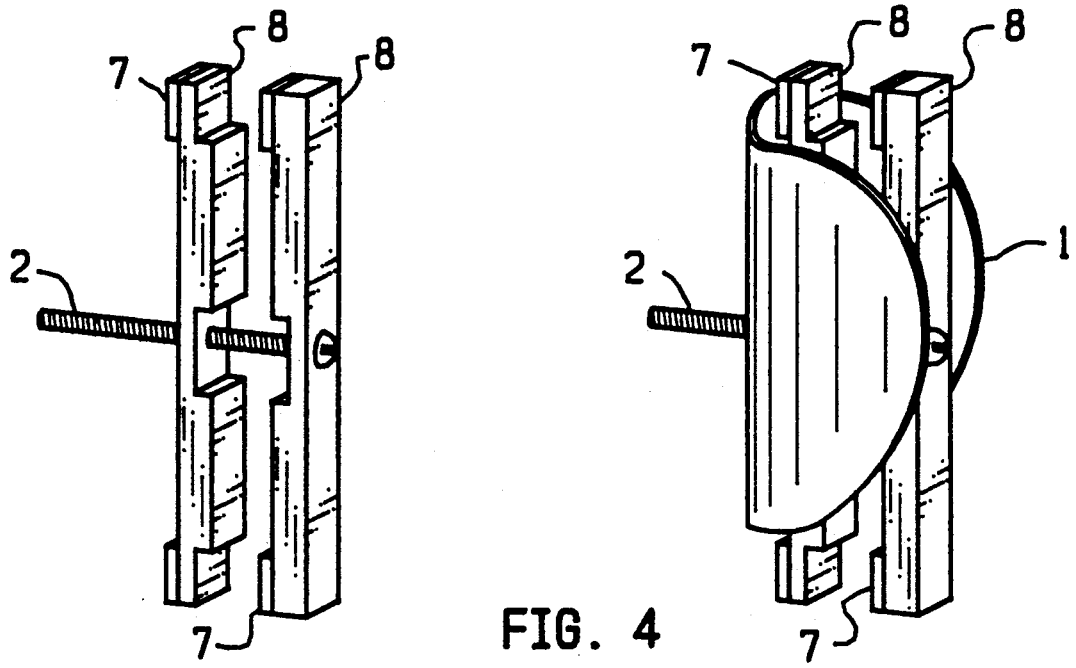
FIG. 4 A manipulation of backing means, including optional crossing strips for subsequent manipulation behind a hole in which the rear surface is inaccessible.

The backing means(1) is now positioned at the rear of said hole(3) by holding the connector (2) and folding rear plate (1) so that it can be pushed through said hole(3). Once through said hole(3), backing means (1) is of such material that it will flatten to its original planar shape and cover the entire rear side of said hole(3)(FIG. 5). If cross strips (8) are used, the strips are rotated until parallel to each other, the backing means (1) is then bent around the strips (8) for positioning through said hole (3) (FIG. 4).

Once positioned on the rear side of said hole (3) the rear plate (1) is adhered to the rear of the panel (9) by holding the connector (2) in such a central location that the backing means (1) covers the entire hole(3). Connecting means is then pulled firmly forward engaging the adhesive pads(7) to the rear of said panel(9). In the case of cross strips (8), the adhesive pads(7) are at the tips of the strips (8)(FIG. 4). Once behind the panel(9) in a similar fashion, as above, the first strip (8) is adhered to the rear of said panel(9) when connector (2) is pulled forward. The "+" intersection of strips (8) can now be erected by rotating the connector 90 degrees and pulling forward again to form an "+" intersection which is now adhered to the rear of the panel at the ends of the crossing strips(8). Said hole (3) is now covered from behind (FIG. 5) and connector (2) extends to the front of said hole (3)(FIG. 5).

Figure 6:
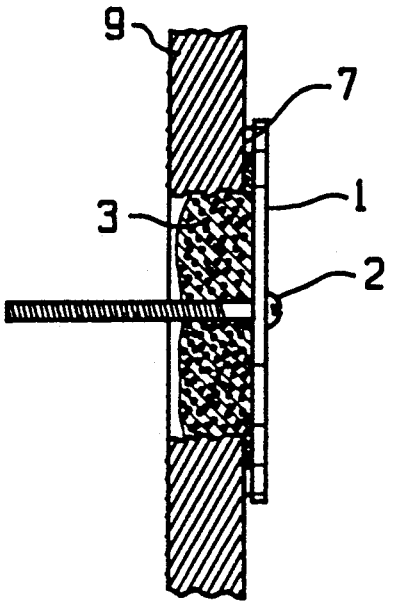
FIG. 6 a schematic side view of the backing means and connecting means in position on a hole in a planar surface, with fluent patching material in position.

Said hole (3) is now filled with a suitable fluent patching material (10) and left slightly below flush with the front surface (approximately 1/8 to ⅛ inch low) FIG. 6. For a shaped or textured repair the impressionable sheet (4)(FIG.2) is attached to the connecting means (2) with said impressionable material (4) placed face inward against the fluid patching material (10). Front dam means (6) is then attached at its center to said connecting means (2).

The connecting means (2) now is tightened and said backing means (1) bends convexly, as shown in FIG. 7, towards the front dam means (6) (FIG. 7). This causes the patching compound (10) to contact the front dam (6) at its center first and work towards the outer edges of said hole(3).

Not only does this push the compound (10) against the impressionable sheet (4) containing the desired texture, but it also pushes air bubbles and gaps outward and away from the visible repaired surface resulting in a flush, clean copy of the panel(9)(FIG. 7). Once the compound (10) has dried, the connector (2) is loosened and the front dam (6) is removed. If the connector bolt (2) is used, the bolt is pushed into and below the visible surface and the small remaining opening is plugged with a dab of putty or compound (10). If a connector (2) cord or string is used the connector (2) is simply severed flush with the surface for a finished surface.

Furthermore, the entire patching procedure can be accomplished in a few minutes and is ready for use as soon as the patching material is dry, Unlike previous art this method creates a structurally sound repair as well as a cosmetically superior finish.

Conclusion

Thus the reader can see that this patching device and procedure is far superior to any existing technologies and fulfills all the requirements for a structurally sound, cosmetically invisible repair of a damage or hole into a planar surface, Additionally, it can be manufactured from inexpensive and common elements.

It is considered that this device and procedure is best used on almost any object needing a repair using a fluent compound in which the appearance of one side of the repair is at issue. Its preferred embodiment would be a planar or semi-planar surface, especially one in which one side of the surface is inaccessible.

While the above description contains many specifications, these should not be construed as limitations on the scope of the invention, but rather as an exemplification of one of its preferred embodiments thereof. Many other variations and applications are possible.

Boat hull repair
Bridge or concrete construction repair
Automotive body repair
Sculpture repair
Plastic repair
Metallic molding
Wax molding
Stucco repair
Drywall and plaster wall repair
Porcelain, enamel or composite repair
Wood repair
Hollow door repair
Most any other structural and/or cosmetic repair using a fluent patching compound

I claim:

1. An apparatus for repairing a hole in an object, said apparatus comprising:

a backing means for positioning behind a hole in an object and thereafter for covering the rear side of said hole in said object, said backing means being substantially flexible to convexly flex into said hole during operation to push a fluent patching material against a front dam means;

an adjustable connecting means engaged with said backing means and extending forward through said hole for subsequent attachment of a front dam means; and an impressionable yet rigid front dam means having a receptacle means for acceptance and subsequent adjustment of said connecting means, said front dam has been impressed with a desired shape or texture, said front dam means and said backing means are substantially imperforate and cover said hole from the respective front and rear side, thereby substantially shaping said fluent material into a desired shape or texture.

2. An apparatus as defined in claim 1, wherein said backing means further includes adhesive means for holding the backing means in position covering the hole during placement of the fluent material therein.

* * * * *